US006966248B2

(12) United States Patent
Mahoney

(10) Patent No.: US 6,966,248 B2
(45) Date of Patent: Nov. 22, 2005

(54) ADJUSTABLE VALVE ROD AND PULL TUBE GUIDE FOR DOWNHOLE PUMPS

(75) Inventor: Mark William Mahoney, Granbury, TX (US)

(73) Assignee: Harbison-Fischer, Inc., Crowley, TX (US)

( * ) Notice: Subject to any disclaimer, the term of this patent is extended or adjusted under 35 U.S.C. 154(b) by 106 days.

(21) Appl. No.: 10/619,336

(22) Filed: Jul. 14, 2003

(65) Prior Publication Data

US 2004/0018101 A1 Jan. 29, 2004

Related U.S. Application Data

(60) Provisional application No. 60/398,460, filed on Jul. 25, 2002.

(51) Int. Cl.[7] ..... F15B 15/24
(52) U.S. Cl. ..... 92/13.41; 92/13.8
(58) Field of Search ..... 92/13.4, 13.41, 92/13.7, 13.8

(56) References Cited

U.S. PATENT DOCUMENTS

| | | | | | |
|---|---|---|---|---|---|
| 2,465,600 | A | * | 3/1949 | Munk | 92/13.8 |
| 2,958,237 | A | * | 11/1960 | Johnson | 92/13.7 |
| 3,097,605 | A | * | 7/1963 | Berkley | 92/13.8 |
| 4,501,119 | A | * | 2/1985 | Stanton | 92/13.7 |
| 4,621,567 | A | * | 11/1986 | Williams | 92/13.7 |

* cited by examiner

*Primary Examiner*—Thomas E. Lazo
(74) *Attorney, Agent, or Firm*—Geoffrey A. Mantooth

(57) ABSTRACT

The guide has a barrel segment and a bushing segment. The barrel segment couples to the upper end of the pump barrel. The bushing segment has a bushing stop. The length of the guide is adjustable so as to vary the length of the bushing stop from the barrel. By varying the length of the guide, the travel of the plunger is adjusted to provide for a small compression chamber without the plunger contacting the barrel.

9 Claims, 5 Drawing Sheets

Prior Art

ADJUSTABLE VALVE ROD AND PULL TUBE GUIDE FOR DOWNHOLE PUMPS

This application claims the benefit of U.S. provisional patent application Ser. No. 60/398,460, filed Jul. 25, 2002.

FIELD OF THE INVENTION

The present invention relates to subsurface, or downhole, pumps, such as are used to pump oil and other fluids and bases from oil wells, and in particular to guides for valve rods and pull tubes.

BACKGROUND OF THE INVENTION

When an oil well is first drilled and completed, the fluids (such as crude oil) may be under natural pressure that is sufficient to produce on its own. In other words, the oil rises to the surface without any assistance.

In many oil wells, and particularly those in fields that are established and aging, natural pressure has declined to the point where the oil must be artificially lifted to the surface. Subsurface, or downhole, pumps are located down in the well below the level of the oil. A string of sucker rods extends from the pump up to the surface to a pump jack device, or beam pump unit. A prime mover, such as a gasoline or diesel engine, or an electric motor, or a gas engine on the surface causes the pump jack to rock back and forth, thereby moving the string of sucker rods up and down inside of the well tubing.

The string of sucker rods operates the subsurface pump. A typical pump has a plunger that is, reciprocated inside of a barrel by the sucker rods. The barrel has a standing one-way valve, while the plunger has a traveling one-way valve. In some pumps, the plunger has a standing one-way valve, while the barrel has a traveling one-way valve. Reciprocation charges a compression chamber between the plunger and the barrel valve with fluid and then lifts the fluid up the tubing toward the surface.

In gaseous wells, gas, such as natural gas, is produced with the liquid oil (and in many wells, water). In gaseous wells, the compression chamber should be as small as possible, in order to increase the compression of the gas to a sufficient pressure so as to open the traveling valve in the plunger. Failing to sufficiently compress the gas results in gas lock, wherein no fluid is pumped.

For a fixed barrel pump, the size of the compression chamber is determined by locating the bottom of the plunger close to the barrel standing valve, when the plunger has reached its lowermost position. The lowermost position of the plunger is determined by a stop, which stop is formed by a guide secured to the top of the barrel. The guide contacts a bushing that is connected by way of a valve rod or pull tube to the plunger. In prior art pumps, the bottom of the plunger is positioned above the barrel standing valve, and thus the size of the compression chamber is determined, by selecting a valve rod or pull tube of suitable length.

The prior practice requires stocking a large number of different sizes of valve rods and pull tubes. Furthermore, prior art practice frequently requires a valve rod or pull tube to be shortened by cutting and possibly rethreading the cut end.

Still another problem with the prior art practice is the inaccuracies introduced into the pump. Sometimes, the guide is tightened onto the barrel after the valve rod or pull tube has been cut to length, resulting in an improperly sized compression chamber.

SUMMARY OF THE INVENTION

It is an object of the present invention to provide a guide for a valve rod and pull tube that allows the size of the compression chamber in a downhole pump to be easily adjusted.

The present invention provides a guide for a reciprocating extension member of a plunger in a downhole pump. The guide has first and second segments. The first segment has a first end structured and arranged to couple to a barrel of the pump. The second segment has a bushing stop at a second end. The first and second segments are coupled together such that the distance between the first and second ends can be adjusted. The first and second segments have a passage therethrough for receiving the extension member.

In accordance with one aspect of the present invention, the first and second segments are coupled together by threads, wherein the first segment has first threads and the second segment has second threads.

In accordance with another aspect of the present invention, there is provided a stop nut located on one of the first or second threads and a stop surface located on the other of the first or second segments for cooperating with the stop nut.

In accordance with another aspect of the present invention, the first segment has openings from the passage to an outside diameter.

In accordance with still another aspect of the present invention, the first end comprises third threads for coupling to the pump barrel. The second end comprises a fishing neck. The first segment has first threads and the second segment has second threads. The first and second segments are coupled to each other by the first and second threads. A stop nut is located on one of the first or second threads and a stop surface is located on the other of the first or second segments for cooperating with the stop nut.

The present invention also provides a downhole pump having a barrel and a plunger. The barrel has a first end and a second end with a standing valve located near the second end and a guide coupled to the first end. The guide has a free end. The plunger is located in the barrel and is structured and arranged to reciprocate therein. The plunger has an extension member that is received by the guide. A bushing is located on the extension member and is structured and arranged to contact the free end of the guide. The free end of the guide is adjustable in distance relative to the first end of the barrel.

In accordance with another aspect of the present invention, the free end of the guide is coupled with the barrel by a threaded fitting and a stop nut.

The present invention also provides a method of assembling a pump. A plunger and an extension member of the plunger are inserted into a barrel. The plunger forms a compression chamber in the barrel. The extension member extends out of an end of the barrel. A guide is coupled onto the end of the barrel such that the extension member passes through the guide. The guide has a free end with the free end of the guide being spaced from the barrel end by a distance. A bushing is coupled to the extension member with the bushing structured and arranged to contact the free end of the guide. The distance of the free end of the guide is adjusted so as to adjust the size of the compression chamber when the bushing contacts the free end of the guide.

In accordance with another aspect of the present invention, the step of adjusting the distance of the free end of the guide further comprises retaining the position of the free end of the guide.

DESCRIPTION OF THE PREFERRED EMBODIMENTS

Figure 1:
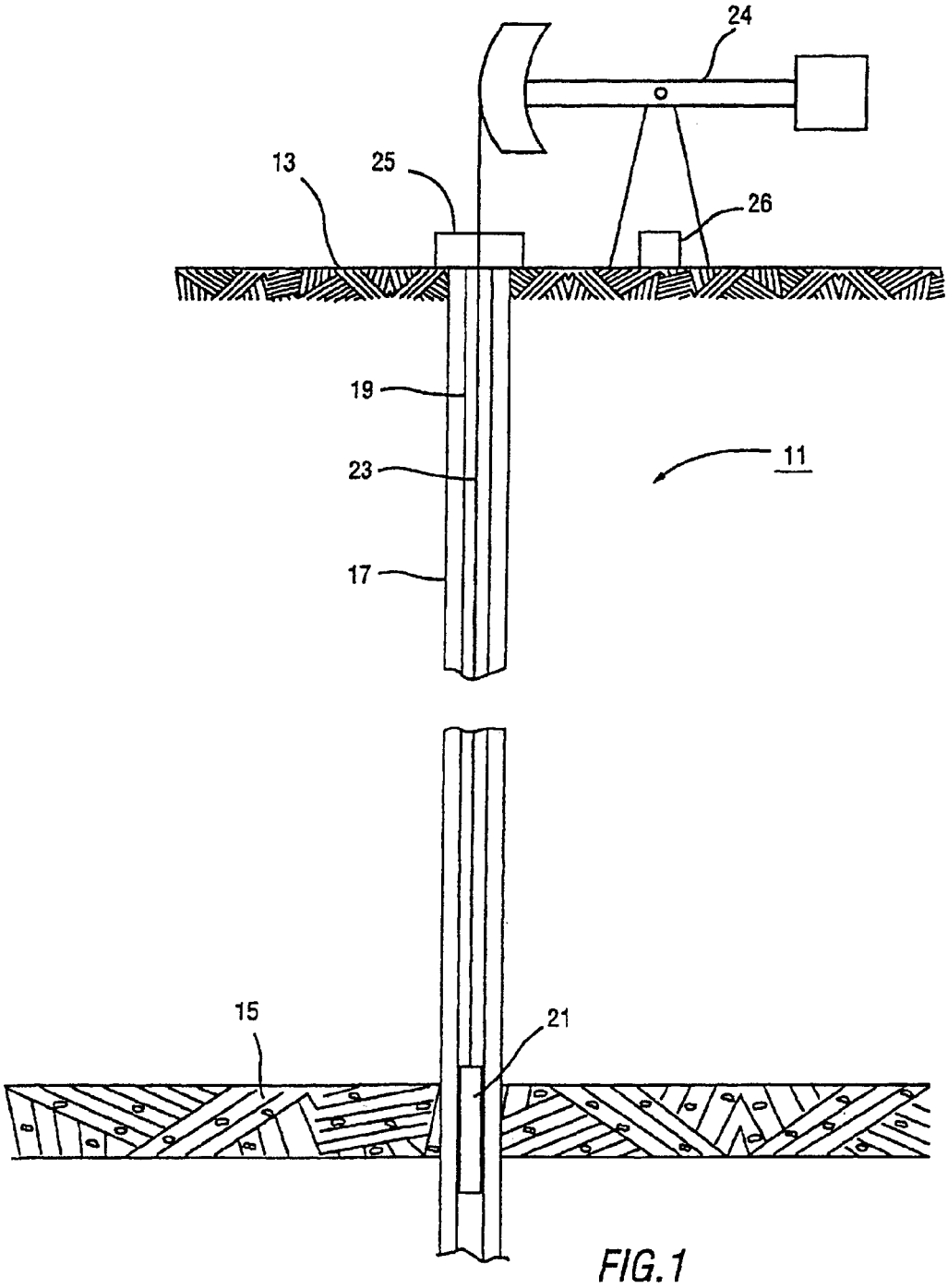
FIG. 1 is a schematic diagram of a well, shown with pumping equipment.

In FIG. 1, there is shown a schematic diagram of a producing oil well 11. The well has a borehole that extends from the surface 13 into the earth, past an oil-bearing formation 15. The borehole has been completed and therefore has casing 17 which is perforated at the formation 15. A packer or other method (not shown) optionally isolates the formation 15 from the rest of the borehole. Tubing 19 extends inside of the casing from the formation to the surface 13.

A subsurface pump 21 is located in the tubing 19 at or near the formation 15. A string 23 of sucker rods extends from the pump 21 up inside of the tubing 19 to a polished rod at a stuffing box 25 on the surface 13. The sucker rod string 23 is connected to a pump jack unit 24 which reciprocates up and down due to a prime mover 26, such as an electric motor, gasoline or diesel engine, or gas engine.

Figure 2:
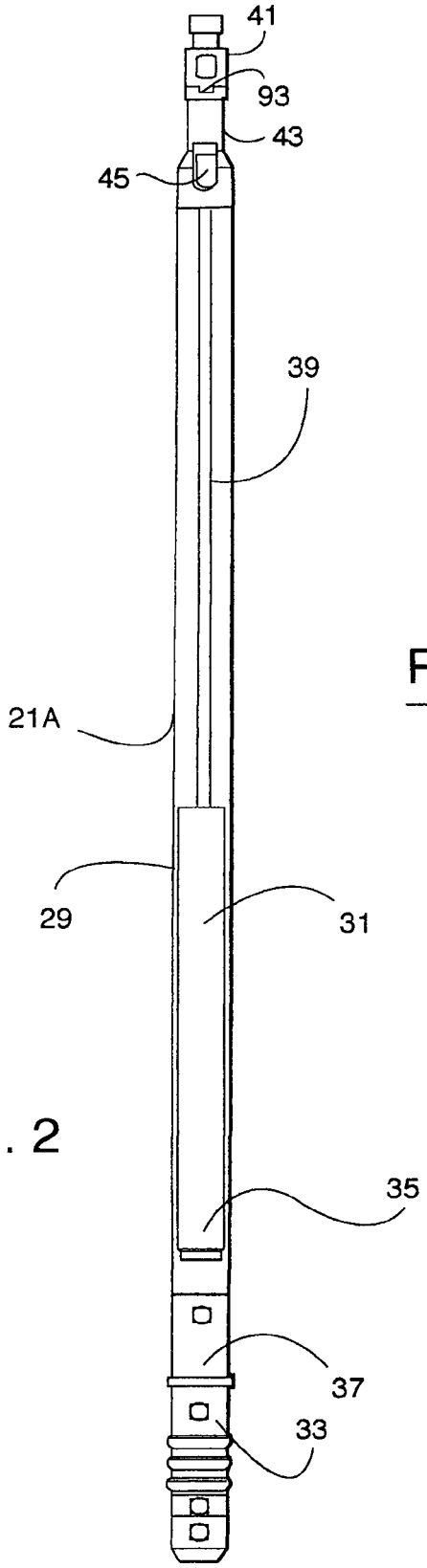
Prior Art FIG. 2
FIG. 2 is a side view of a prior art pump, shown partially broken away.

FIG. 2 shows a prior art pump 21A. The pump 21A has a barrel 29 and a plunger 31 that reciprocates inside of the barrel. The barrel 29 has a standing valve 33, while the plunger 31 has a traveling valve 35 typically located near its bottom end. The present invention may be used in a variety of pumps, such as insert type pumps and tubing type pumps.

The plunger 31 is reciprocated inside of the barrel 29 by the sucker rods 23. As the plunger is raised on the upstroke, fluid is drawn through the standing valve 33 into a compression chamber 37. The traveling valve 35 is closed on the upstroke. As the plunger 31 descends on the downstroke, the standing valve 33 is closed and the fluid in the compression chamber 33 flows through the traveling valve 35 into the plunger 31 and the tubing above the plunger. This fluid is lifted on the next upstroke. The reciprocating movement of the plunger inside of the barrel is repeated to lift fluid to the surface.

Figure 3:
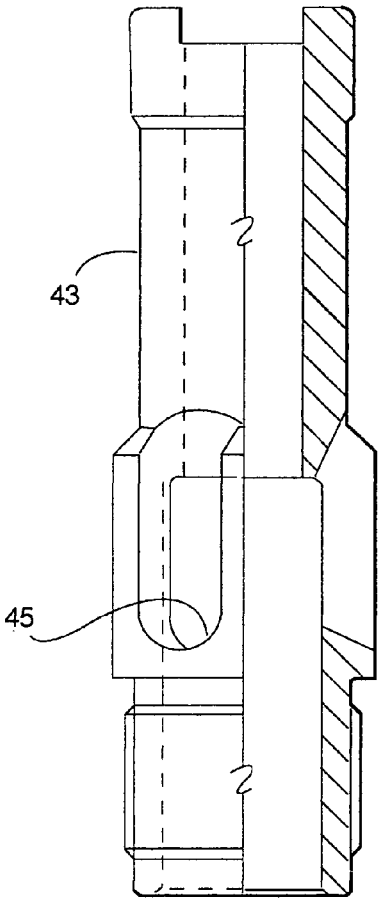
FIG. 3 Prior Art
FIG. 3 is a side, partial cross-sectional view of a prior art valve rod guide.

The upper end of the plunger 31 is connected to a valve rod 39. The upper end of the valve rod 39 is connected to a bushing 41, which bushing is connected to the lower end of the sucker rod string 23. The valve rod 39 passes through a valve rod guide 43 (see FIG. 3), which guide is connected to the top of the barrel 29. The rod guide 43 centers the valve rod 39 and therefore assists in centering the plunger 31 within the inside diameter of the barrel 29.

In addition, the rod guide 43 has apertures 45, or openings, for allowing the fluid to exit the pump into the tubing.

Figure 4:
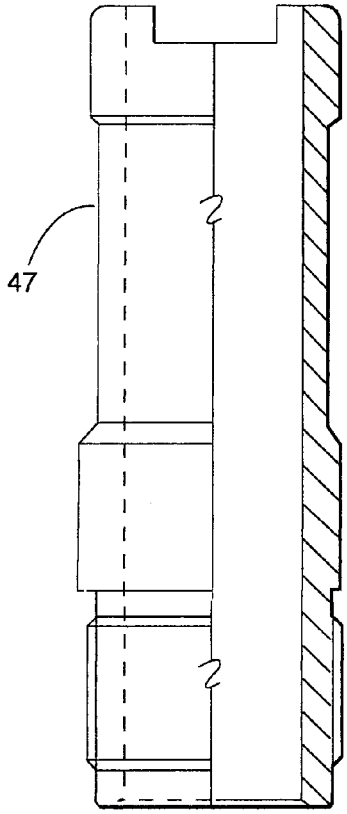
FIG. 4 is a side, partial cross-sectional view of a prior art pull tube guide.

In some pumps, a pull tube is used in lieu of a valve rod 39. A pull tube is hollow and allows fluid to flow therethrough. The lower end of the pull tube is connected to the plunger 31, while the upper end is connected to the bushing 41. A valve cage can be located above the bushing. The guide 47 (see FIG. 4) for the pull tube is similar to the guide 43 for a valve rod, however, the pull tube guide need not have apertures. Also, the inside diameter of a pull tube guide is typically larger to accommodate the larger outside diameter of the pull tube. The fluid exits the pump through apertures in the pull tube or by way of the valve cage above the pull tube. In the description herein, the discussion and illustration of a valve rod shall encompass a pull tube. The term "extension member" shall refer to both a valve rod and a pull tube, as well as other members that are received by a guide.

Ideally, the fluid that is to be pumped contains only liquids such as oil or water. However, the fluid may also contain gas, such as natural gas. In the event the fluid contains gas, it is desirable for the compression chamber 37 to be small when the plunger has reached the end of the down stroke. This allows pressure to increase to the point of properly activating the valves 33, 35. The size of the compression chamber is determined by the extent of travel of the plunger inside of the barrel. The downward travel of the plunger 31 within the barrel 29 is stopped by the bushing 41 contacting the upper end of the guide 43.

In the prior art, the length of the guide 43, 47 is fixed. The size of the compression chamber 37 is determined by the length of the valve rod 39. That is to say that the valve rod length is chosen and modified so as to allow the plunger to descend into the barrel for some distance. With the present invention, the length of the guide is adjustable. Thus, the valve rod length need not be adjusted to the pump. The size of the compression chamber is instead determined by adjusting the length of the guide.

Figure 5:
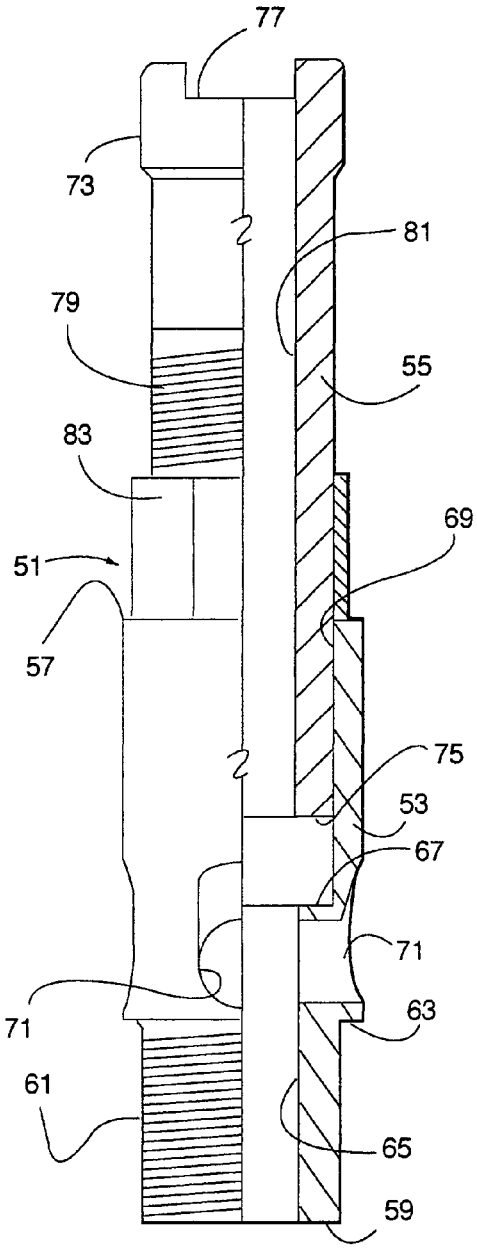
FIG. 5 is a side, partial cross-sectional view of the guide of the present invention, in accordance with a preferred embodiment.

FIG. 5 shows a guide 51 of the present invention, in accordance with a preferred embodiment. The guide has several segments, namely a barrel segment 53 and a bushing segment 55. The two segments 53, 55 couple together so that one segment protrudes from the other at lengths that can be adjusted.

The barrel segment 53 is generally tubular, having an upper end 57 and a lower end 59. In the description herein, the relative terms "upper" and "lower" are used with reference to the orientation shown in the Figures. The lower end 59 has a male threaded fitting 61 for coupling to the upper end of the barrel 29. A shoulder surface 63 is formed above the threaded fitting 61. The shoulder surface 63 abuts the upper end of the barrel. The upper end 57 forms a stop surface. A passage 65 extends through the barrel segment between the upper and lower ends 57, 59. An inner shoulder 67 is formed in the passage 65 so as to face the upper end 57. The upper end portion 69 of the passage 65 is threaded from the upper end 57 to the inner shoulder 67. The lower end of the passage, below the inner shoulder 67, is smooth. The barrel segment 53 has openings 71 through the wall.

The bushing segment 55 is generally tubular, having an upper end 73 and a lower end 75. The upper end 73 has a notch 77 for receiving the bushing 41. The upper end 73 is configured as a conventional fishing neck for retrieval purposes. The upper end 73 also forms a stop for the bushing 41. The outside diameter of the bushing segment 55 has threads 79 from the lower end 75 toward the upper end 73. A smooth passage 81 extends between the upper and lower ends 73, 75. The inside diameter of the passage 81 is preferably smaller than the inside diameter of the passage 65 in the barrel segment 53. This provides an annular space around the valve rods so that the fluid can flow out of the openings 71.

A nut 83 is provided on the threads 79 of the bushing segment 55. The nut 83 is designed to abut against the stop shoulder 57 of the barrel segment 53.

The bushing segment 55 is threaded into the barrel segment 53 such that the threads 69, 79 are coupled together.

Figure 6:
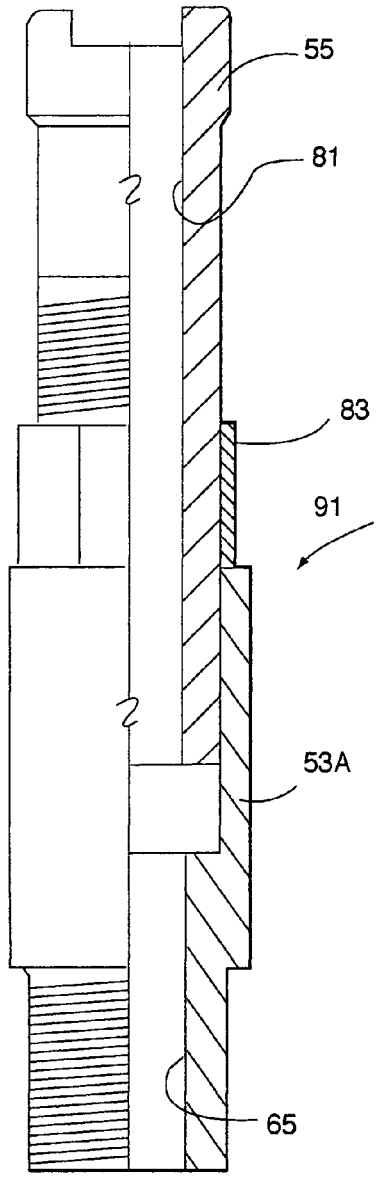
FIG. 6 is a side, partial cross-sectional view of a guide in accordance with another embodiment.

Referring to FIG. 6, the guide 91 for the pull tube is substantially similar to the valve rod guide 51, with some differences. The guide 91 has a barrel segment 53A, a bushing segment 55 and a nut 83. The barrel segment 53A need not have openings 71. Also, the inside diameter of the passage 65 need not be larger than the inside diameter of the bushing segment passage 81.

Figure 7:
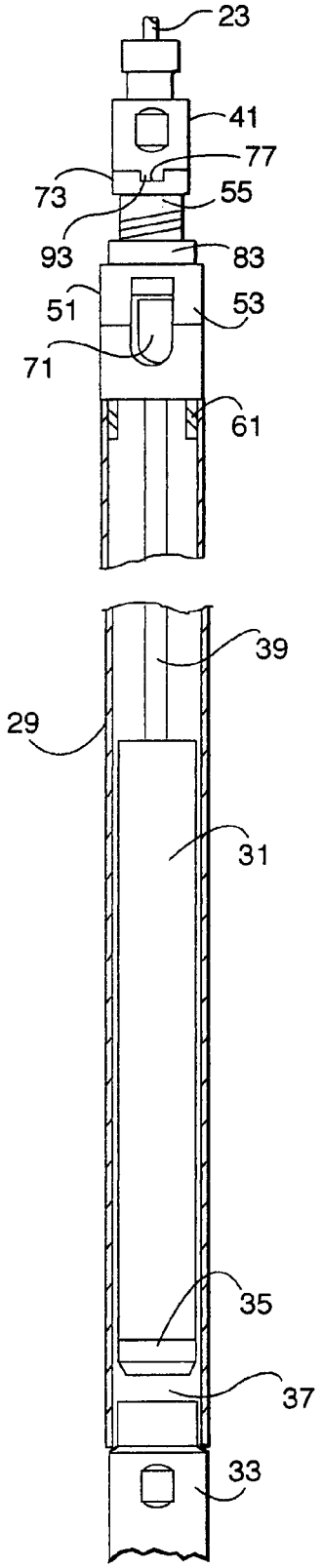
FIG. 7 is a side, partial cross-sectional view of portions of a pump equipped with the guide of the present invention.

The use of the guide 51 will now be explained with reference to FIG. 7. The adjustment in the length of the guide is typically made when the pump is assembled or reassembled. A valve rod 39 of suitable length is selected and assembled to the plunger. With a typical pump, the length of the valve rod 39 should be suitable to within about + or −1 inch. This is an improvement over the prior art that requires the valve rod length to be within a quarter inch. Of course, if the guide is designed to provide more adjustment, then the tolerance of the valve rod length can be even larger than an inch.

The plunger 31 is inserted into the barrel with the valve rod protruding from the upper end of the barrel. The assembled guide 51 is inserted along the valve rod 39 such that the barrel segment 53 is closest to the barrel 29. The barrel segment fitting 61 is coupled to the upper end of the barrel 29. The valve rod 39 protrudes from the upper end of the guide 51. The bushing 41 is attached to the end of the valve rod 39. The bushing 41 is then brought into contact with the upper end 73 of the bushing segment 55. The bushing 41 and valve rod 39 are rotated until the bosses 93 on the bushing are received by the notches 77. This ensures that the plunger 31 is at its lowermost position in the barrel.

The nut 83 is moved toward the upper end 73 of the bushing segment 55. This allows the bushing segment 55 to be moved relative to the barrel segment 53. The bushing segment 55 is moved into the barrel segment 53 so as to shorten the guide. Conversely, the guide can be lengthened by moving the bushing segment out of the barrel segment. Because the segments 53, 55 are threaded together, moving one segment with respect to the other involves rotating one segment with respect to the other.

To adjust the length of the guide 51, and the size of the compression chamber 37, the bushing segment 55 is moved into the barrel segment 53 so as to shorten the guide until the bottom of the plunger 31 contacts the bottom of the compression chamber 37. At this point, the compression chamber is at its smallest. Contacting the barrel with the plunger during stroking is harmful to the pump components, so the plunger is spaced up slightly by lengthening the guide 51. Thus, the bushing segment 55 is moved out of the barrel segment 53 a short distance (for example ¼ inch). This ensures that the plunger will not contact the barrel during reciprocation.

Once the guide 51 is at the proper length, the length is fixed by moving the nut 83 down to the stop surface 57 (see FIG. 5). The guide 51 is now set.

The reciprocating movement of the pump causes the valve rod 39 to reciprocate inside of the bushing segment 55. On the downstroke, the bushing 41 contacts the upper end 73 of the bushing segment, wherein downward motion of the plunger is stopped.

With the adjustable guide of the present invention, the number of lengths of valve rods and pull tubes can be reduced, thereby shrinking inventory. In addition, the length of the valve rod or pull tube need not be cut or shortened, as the length adjustment is made with the guide and not with the valve rod or pull tube. Thus, no rethreading or other alteration to the valve rod or pull tube is required.

In the preferred embodiment shown and described, the two segments are coupled together by threads. Other mechanisms for coupling the two segments together can be used.

In addition, the threads of the bushing segment can be inside diameter threads that receive outside diameter threads of the barrel segment.

Furthermore, the guide can be one piece instead of two pieces. In this instance, the bushing segment is threaded directly into the upper end of the barrel. The upper end of the barrel may require more threads to allow for adjustment in the distance of the free end 73 relative to the upper end of the barrel. The upper end of the barrel forms a stop surface for the nut 83. Such a one-piece guide is particularly well suited for a pull rod type pump, however it can be used for a valve rod pump.

The foregoing disclosure and showings made in the drawings are merely illustrative of the principles of this invention and are not to be interpreted in a limiting sense.

What is claimed is:

1. A guide for reciprocation of an extension member of a plunger in a downhole pump, comprising:

a) a first segment having a first end structured and arranged to couple to a barrel of the pump;

b) a second segment having a bushing stop at a second end;

c) the first and second segments coupled together such that the distance between the first and second ends can be adjusted, the first and second segments having a passage therethrough for receiving the extension member.

2. The guide of claim 1 wherein the first and second segments are coupled together by threads, wherein the first segment has first threads and the second segment has second threads.

3. The guide of claim 2 further comprising:

a) a stop nut located on one of the first or second threads;

b) a stop surface located on the other of the first or second segments for cooperating with the stop nut.

4. The guide of claim 1 wherein the first segment has openings from the passage to an outside diameter.

5. The guide of claim 1 wherein:

a) the first end comprises third threads for coupling to the pump barrel;

b) the second end comprises a fishing neck;

c) the first segment has first threads and the second segment has second threads, the first and second segments coupled to each other by the first and second threads;

d) a stop nut located on one of the first or second threads;

e) a stop surface located on the other of the first or second segments, for cooperating with the stop nut.

6. A downhole pump, comprising:

a) a barrel having a first end and a second end, with a standing valve located near the second end and a guide coupled to the first end, the guide having a free end;

b) a plunger located in the barrel and structured and arranged to reciprocate therein, the plunger having an extension member that is received by the guide;

c) a bushing located on the extension member and structured and arranged to contact the free end of the guide;

d) the free end of the guide being adjustable in distance relative to the first end of the barrel.

7. The pump of claim 6 wherein the free end of the guide is coupled with the barrel by a threaded fitting and a stop nut.

8. A method of assembling a pump, comprising the steps of:

a) inserting a plunger and an extension member of the plunger into a barrel, the plunger forming a compression chamber inside of the barrel, the extension member extending out of the barrel;

b) coupling a guide onto the end of the barrel such that the extension member passes through the guide, the guide having a free end, the free end of the guide being spaced from the barrel end by a distance;

c) coupling a bushing to the extension member, the bushing being structured and arranged to contact the free end of the guide;

d) adjusting the distance of the free end of the guide so as to adjust the size of the compression chamber.

9. The method of claim 8 wherein the step of adjusting the distance of the free end of the guide further comprises the step of retaining the position of the free end of the guide.

* * * * *